US006308920B1

(12) United States Patent
Zander

(10) Patent No.: US 6,308,920 B1
(45) Date of Patent: Oct. 30, 2001

(54) SWITCH ACTUATOR

(76) Inventor: Dennis Zander, 35 Rolling Meadows, Penfield, NY (US) 14526

( * ) Notice: Subject to any disclaimer, the term of this patent is extended or adjusted under 35 U.S.C. 154(b) by 0 days.

(21) Appl. No.: 09/611,892

(22) Filed: Jul. 7, 2000

(51) Int. Cl.[7] ..... E01B 7/00
(52) U.S. Cl. ..... 246/415 A
(58) Field of Search ..... 246/415 R, 415 A, 246/393

(56) References Cited

U.S. PATENT DOCUMENTS 4,077,591 3/1978 Ray .
4,355,776 10/1982 Rydin .
4,695,016 * 9/1987 Worack ..... 246/415 A
5,494,242 * 2/1996 Ludwick et al. ..... 246/393
5,752,678 5/1998 Riley .

* cited by examiner

*Primary Examiner*—S. Joseph Morano
*Assistant Examiner*—Robert J. McCarry, Jr.
(74) *Attorney, Agent, or Firm*—Stephen B. Salai, Esq.; Brian B. Shaw, Esq.; Harter, Secrest & Emery LLP

(57) ABSTRACT

A compact switching apparatus for a model railroad track, the apparatus having the capability of smoothly driving a track switch between terminal positions while providing for intended manual operation while precluding the reverse operation of the apparatus by the track switch. Circuitry includes light emitting diodes to indicate the position of the switch, and can also provide a residual holding current which helps maintain the switch in its intended position.

26 Claims, 8 Drawing Sheets

FIG. 8,
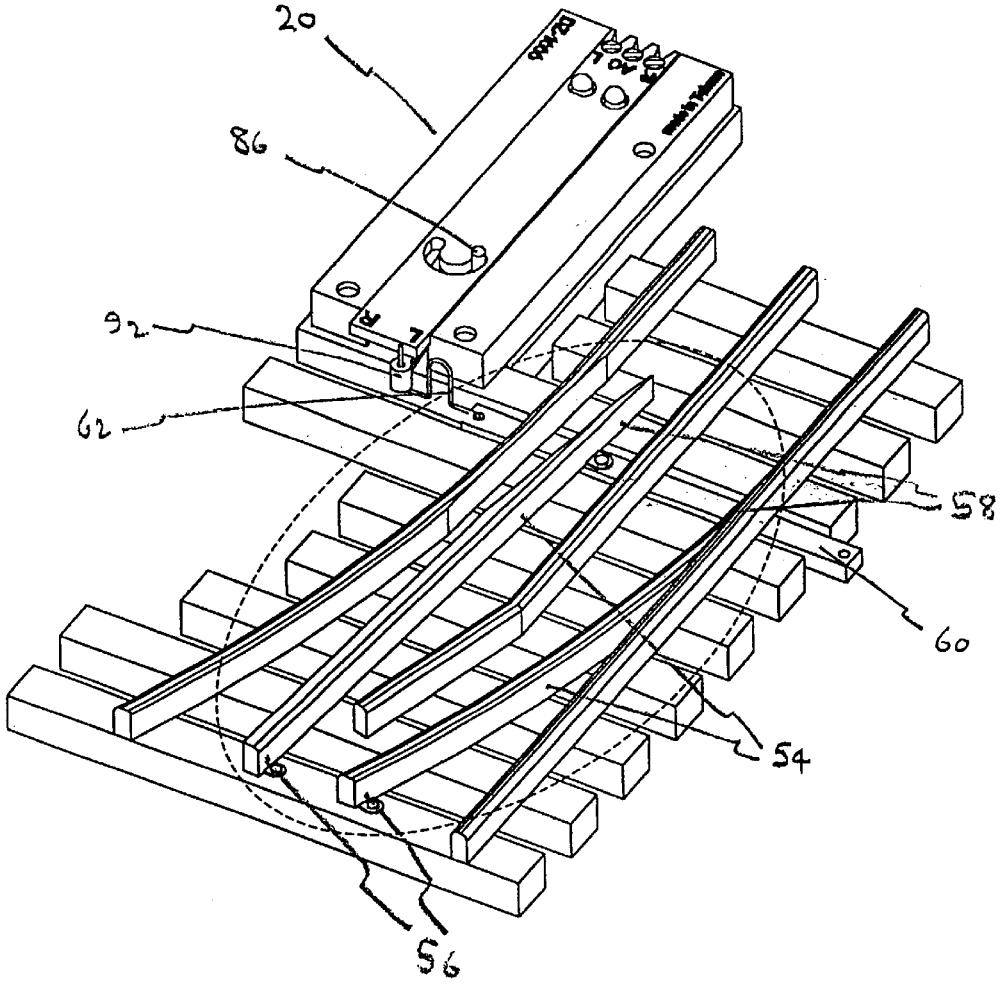

SWITCH ACTUATOR

FIELD OF THE INVENTION

The invention relates to model railroad switches and more particularly to an actuator for a model railroad switch.

BACKGROUND OF THE INVENTION

Although a multiplicity of switch actuators, often referred to as switch machines, exists, there is a need for a compact, reliable switch actuator.

One type of known switch actuator uses solenoid coils arranged in a push-pull configuration to move a plunger back and forth. The plunger is connected to the switch mechanism by a linkage. A number of different actuators of this type are available, and all have the advantage of allowing a desirable long thin form factor that is well suited for placement between closely adjacent lines of track.

Push-pull solenoid actuators have several disadvantages. They act very quickly, which might seem like an advantage, but fail to accurately simulate the action of real switches. In addition, they are electrically inefficient and require considerable power to operate. If power is applied to a solenoid coil of a push-pull solenoid actuator over an extended period of time, either accidentally or purposefully, the coil may generate a substantial amount of heat, sometimes enough to cause the destruction of the actuator.

Some switching arrangements cause a switch actuator to move a switch to a safe position when a train approaches. Arrangements of this type sometimes lead to conditions, such as when a train is stalled on a section of track, that apply power to actuators for an extended period of time. While thermal protection could be added to push-pull solenoid switch actuators, doing so would increase the price and complexity of the actuators, large numbers of which may be required in complex railroad layouts.

Another disadvantage of push-pull solenoid actuators is that while the actuator can effectively operate the switch mechanism, the reverse is also true, that is applying force to the switch mechanism can easily move the solenoid, thereby allowing the switch mechanism to be manually moved from one position to another. This can create problems. If the switch is manually moved from one of two safe positions, derailments can occur. Also, some control systems require that the position of all switches is known, and the possibility that a switch can be manually moved from the position selected by the actuator frustrates this.

Some push-pull solenoid actuators include latching mechanisms to overcome this problem. That is, the switch actuators are designed so that the solenoid can move the switch mechanism from one position to the other, but force applied to the switch mechanism cannot move the switch from the selected position.

In an attempt to overcome some of these problems, actuators are available that use small electric motors to operate the switch mechanism. Electric motors can more accurately simulate the action of real switches, and are desired by enthusiasts. Actuators are available that purposefully reduce the speed of operation well below that which is possible with a solenoid to more accurately simulate authentic switching action.

An example of a slow motion switch actuator is described in U.S. Pat. No. 4,695,016 to Worack. The actuator uses a small high speed motor coupled to a gear train for operating an output pin that is connected to a switch. While the mechanism described in the '016 patent provides a realistic switching action, it introduces an additional problem. The gearing mechanism provides no protection against manual operation of the switch. The motors used in switch actuators of the type described in the '016 patent, for cost reasons, are not as small as would be desirable. Depending on the particular design, it can be relatively easy to move a switch operated by a motor driven switch actuator manually from one position to another, intentionally or otherwise.

Moreover, known switch actuators such as the actuator shown in the '016 patent, are larger than is desirable, and cannot be physically mounted between adjacent lines of track. One solution is to mount the actuators beneath the platform supporting the model railroad layout. While this hides the bulky actuator, it makes installation more difficult and is undesirable for that reason.

It is an object of this invention to provide a switch actuator, switch machine for a model railroad switch that overcomes all of the problems of prior art switch machines mentioned above.

It is another object of this invention to provide a switch machine that is compact and reliable.

It is another object of this invention to provide a switch machine that has a long, thin form factor similar to a push-pull solenoid actuator, but which has the aesthetic advantages of a motor driven actuator.

It is another object of this invention to provide a motor driven actuator that effectively resists manual movement of a switch in a way previously obtainable only in solenoid actuators.

In accordance with another aspect of the invention, the face gear includes a manual actuator permitting rotation of the face gear for manually moving a switch.

In accordance with another aspect of the invention, the face gear includes an indicator actuator for visually indicating the position of a switch.

In accordance with another aspect of the invention, the switch machine provides for a small residual current through the motor, which ensures that the machine is maintained in a selected position.

SUMMARY OF THE INVENTION

Briefly stated, and in accordance with a presently preferred embodiment of the invention, a switch machine comprises a motor having an output shaft aligned with a longitudinal axis of the motor, a pinion attached to the output shaft of the motor, a face gear engaging the pinion, a cam on the face gear, an elongated actuator lever having a primary access aligned with the access of the motor, and a cam-following surface on the lever engaging the cam, the force exerted by the cam on the cam-following surface being substantially perpendicular to the axis of the face gear for substantially preventing force exerted on the actuator from turning the face gear.

The motor is a DC motor, which is powered by rectified current from an AC source. The direction of the current through the motor, and hence the direction of rotation of the shaft, is determined by switching the current to pass through either of two oppositely disposed steering diodes.

BRIEF DESCRIPTION OF THE DRAWINGS

FIG. 8 shows the switch machine connected to a track switch.

DETAILED DESCRIPTION OF THE PREFERRED EMBODIMENT

Figure 1:
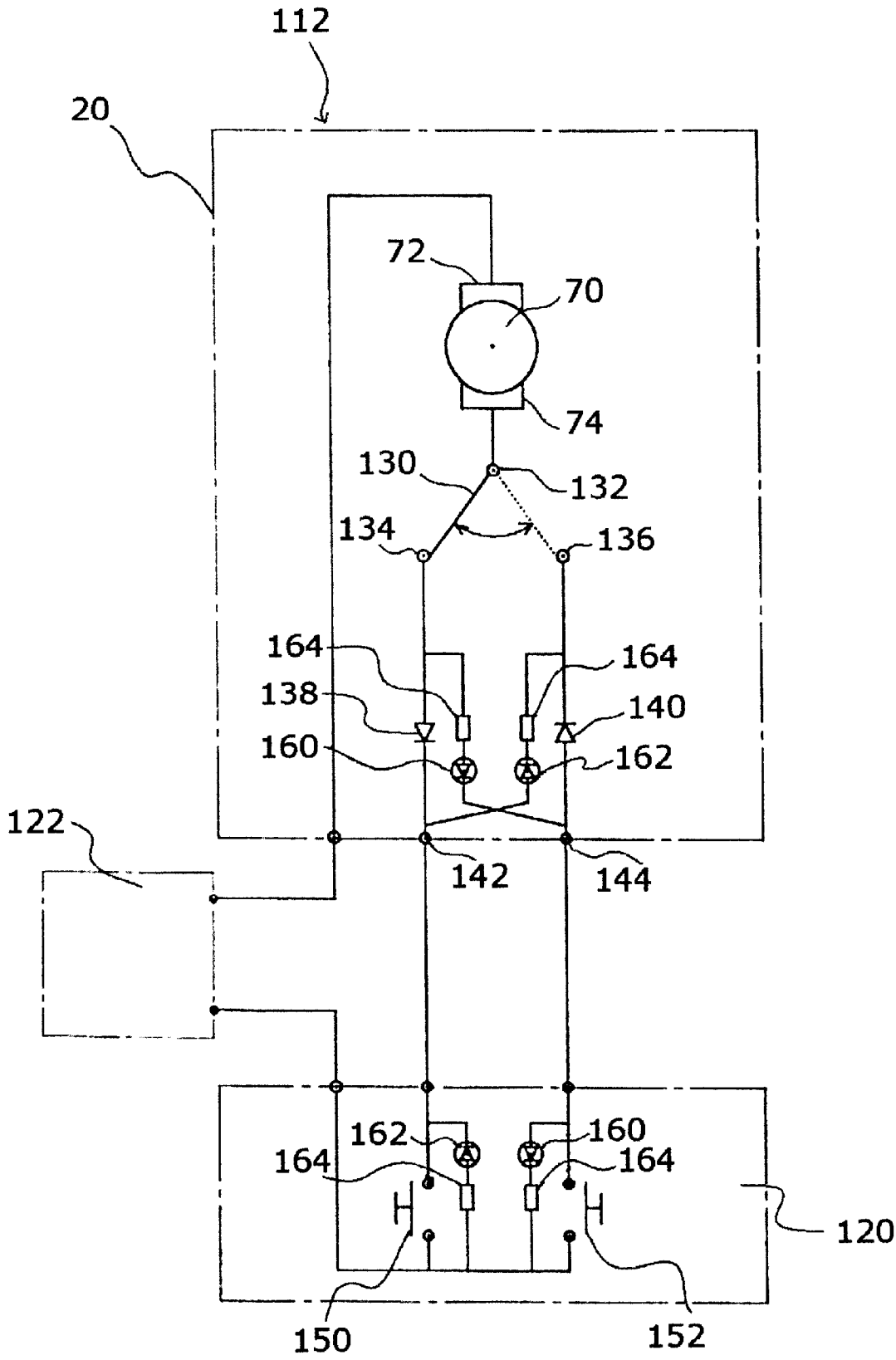
FIG. 1 shows an electronic circuit for a switch machine and controller.

Referring now to the drawings, a model railroad switching apparatus 20 has an elongate housing 30, with a body 32 which has a substantially flat top portion 34 but is open from below. An underside cover plate, which is present in the completed assembly, is not shown. As best shown in FIG. 8, the housing 30 is mounted alongside a section of track 50 including a track switch 52, which lies within the area enclosed by the dotted line and consists of two rails 54. Each rail has a pivotable but otherwise fixed end 56 and a movable end 58, the movable ends 58 being connected to a common throw bar 60 which can be moved laterally relative to the track 50 between two functional positions. FIG. 8 shows the switch 52 in a position which would guide a train through a turnout curve; in the alternative position to that of FIG. 8, the train would follow a straight through path.

Within the body 32 is mounted a DC electric motor 70 with a longitudinal, reversibly rotatable, driveshaft 76 whereto is concentrically affixed a pinion 78, which engages a face gear or crown gear 80. The face gear 80 is disposed so that it in response to the rotation of the pinion 78, it can rotate about a generally vertical axis 82.

Figure 4:
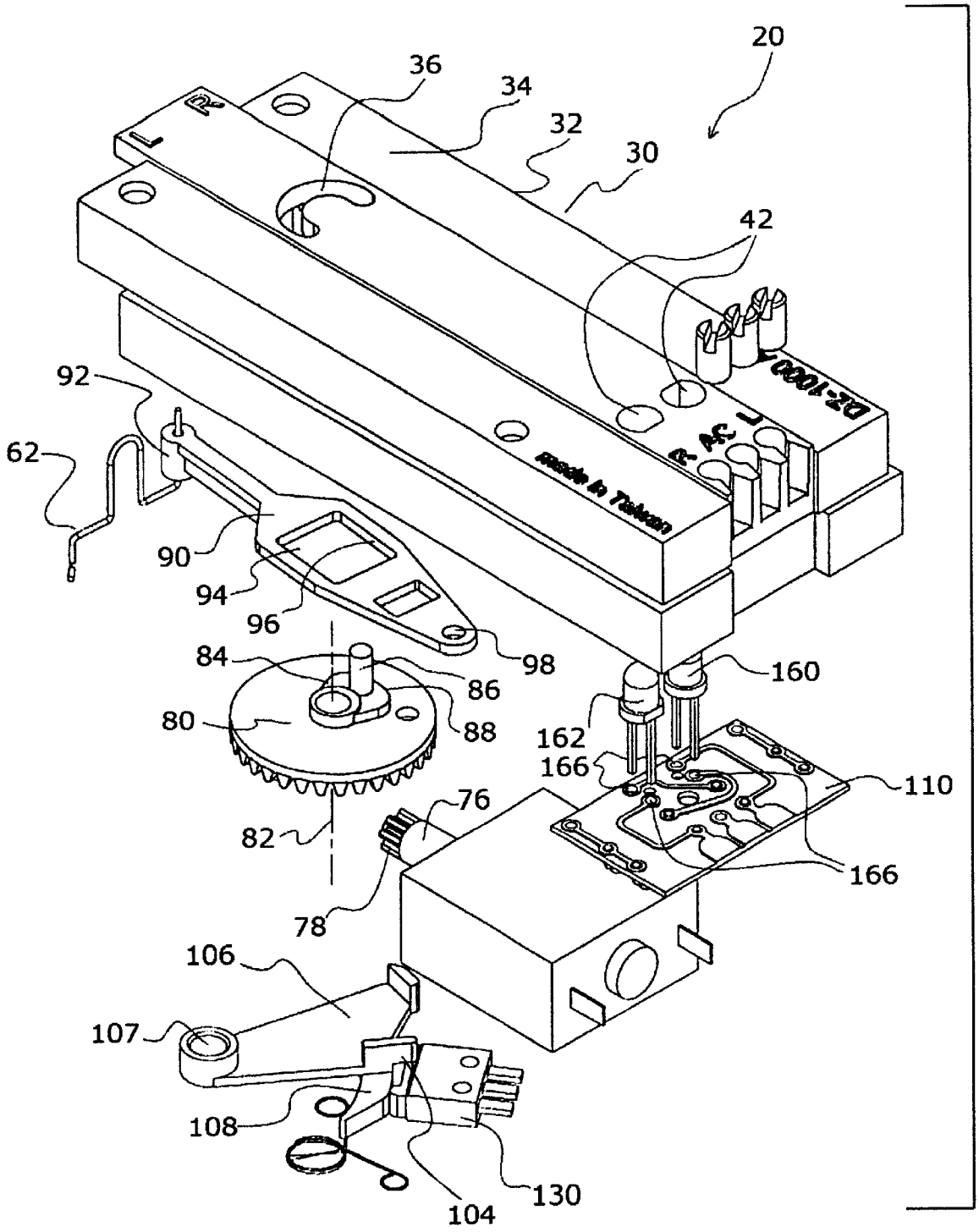
FIG. 4 shows an exploded view of the switch machine from above.
Figure 5:
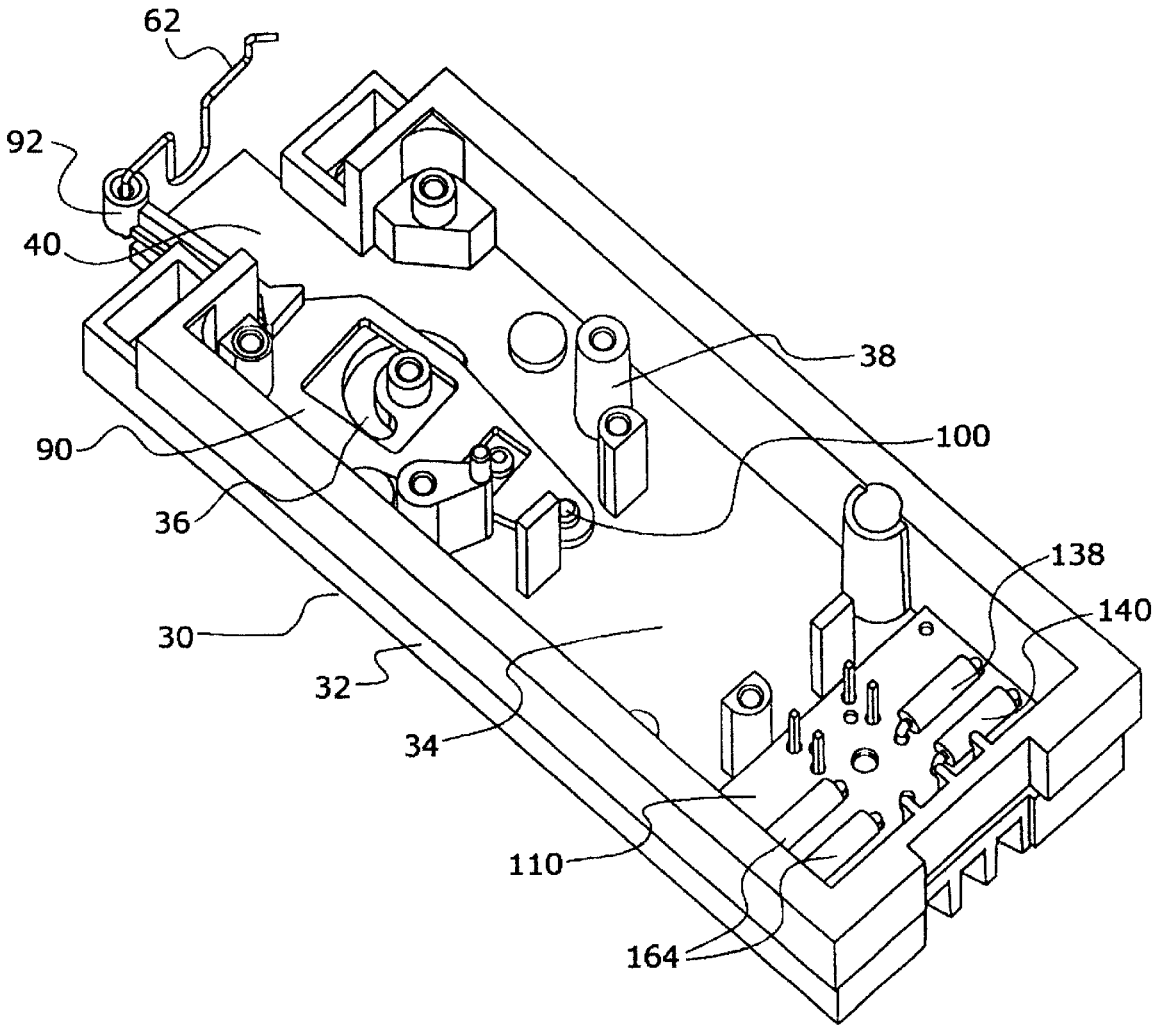
FIG. 5 shows an actuating lever mounted in position on a body of the switch machine.

As best seen in FIG. 4, the side of the face gear 80 opposite the pinion 78 has a cam 84 which is fixedly attached thereto and therefore rotates about the same axis 82. A cam-post 86 projecting upwardly from the cam 84 is parallel to, but spaced apart from, the axis 82. The cam 84 has a functional surface 88, which is generally concentric with the face gear 80. A longitudinal lever 90 has a pivot hole 98 movably engaging a pivot post 100, which is attached to the body 32. An end 92 of the lever 90 protrudes beyond the housing 30 through an opening 40, and is operably connected to the throw bar 60 by a coupling 62 which is preferably a spring link. The lever 90 has a generally rectangular aperture 94, which receives the cam 84 so that the functional surface 88 engages a cam-following surface 96. When actuated by the motor 70, the cam 84 can cause the lever 90 to be move smoothly between a left terminal position and a right terminal position, shown respectively in FIGS. 6 and 7, causing a corresponding movement of the track switch 52.

The apparatus 20 also provides that the track switch 52 can be operated manually. The cam-post 86 projects above the top portion 34 through an arcuate slot 36 shaped to allow the post to be moved by an operator so that the cam 84 cam can be rotated and the track switch 52 actuated manually. Simply rotating the cam-post 86 from one side to the other will rotate the crown gear 80, which drives the lever 90 and throws the track switch 52 to its alternate position. However, it is important to distinguish between intended manual operation and unintended movement of the track switch 52 in response, say, to vibration of the track caused by a nearby train. It is evident especially from FIGS. 6 and 7 that any force transmitted from the track switch 52 to the lever 90 would be resisted, since a resultant force on the cam would be substantially directed towards the axis 72 of the face gear 70, and would therefore have insufficient moment about the axis 72 to cause rotation of the face gear 70. Therefore, unintended movement of the track switch 52 is precluded.

Figure 6:
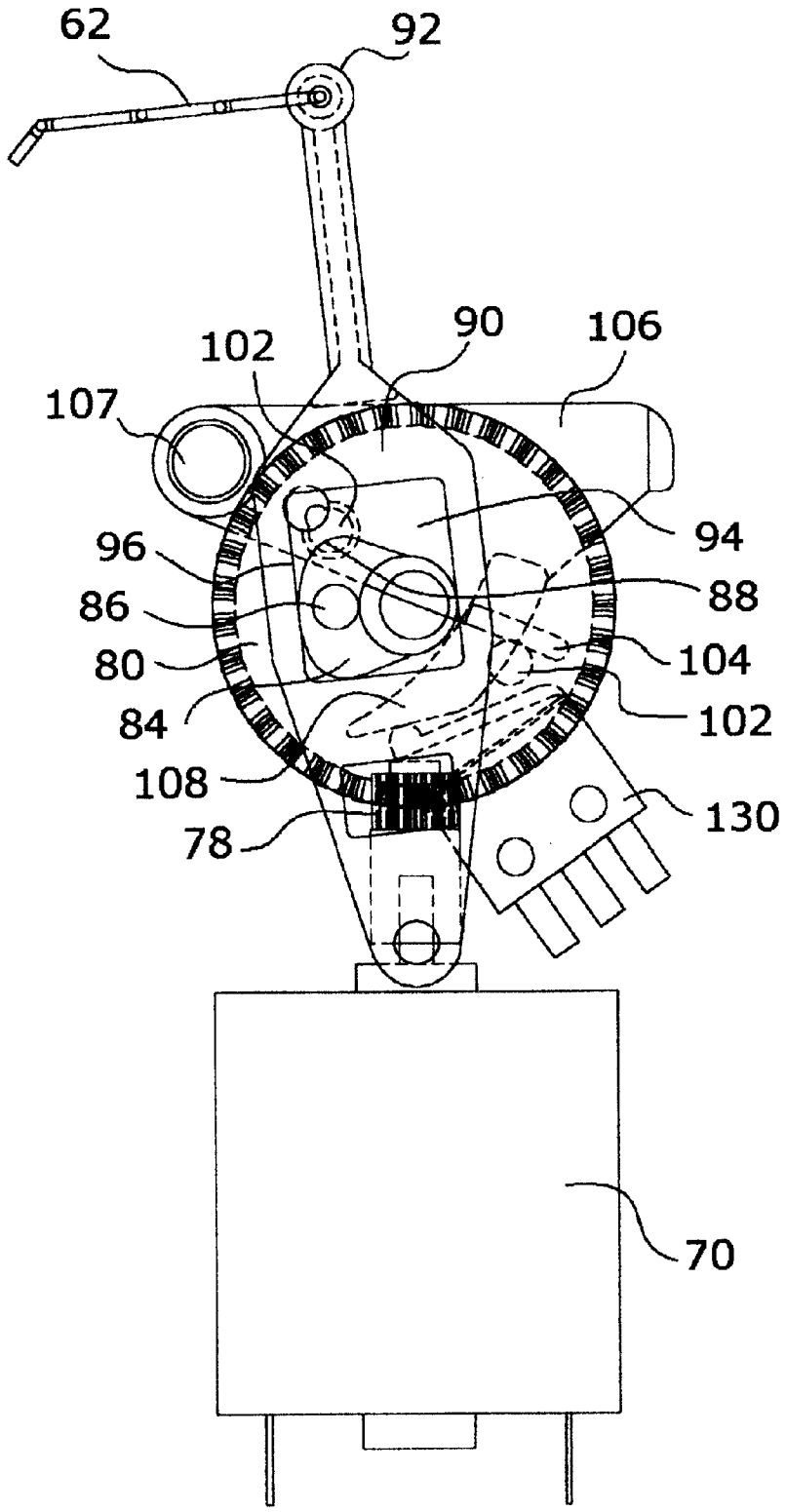
FIG. 6 shows the lever in a left terminal position.
Figure 7:
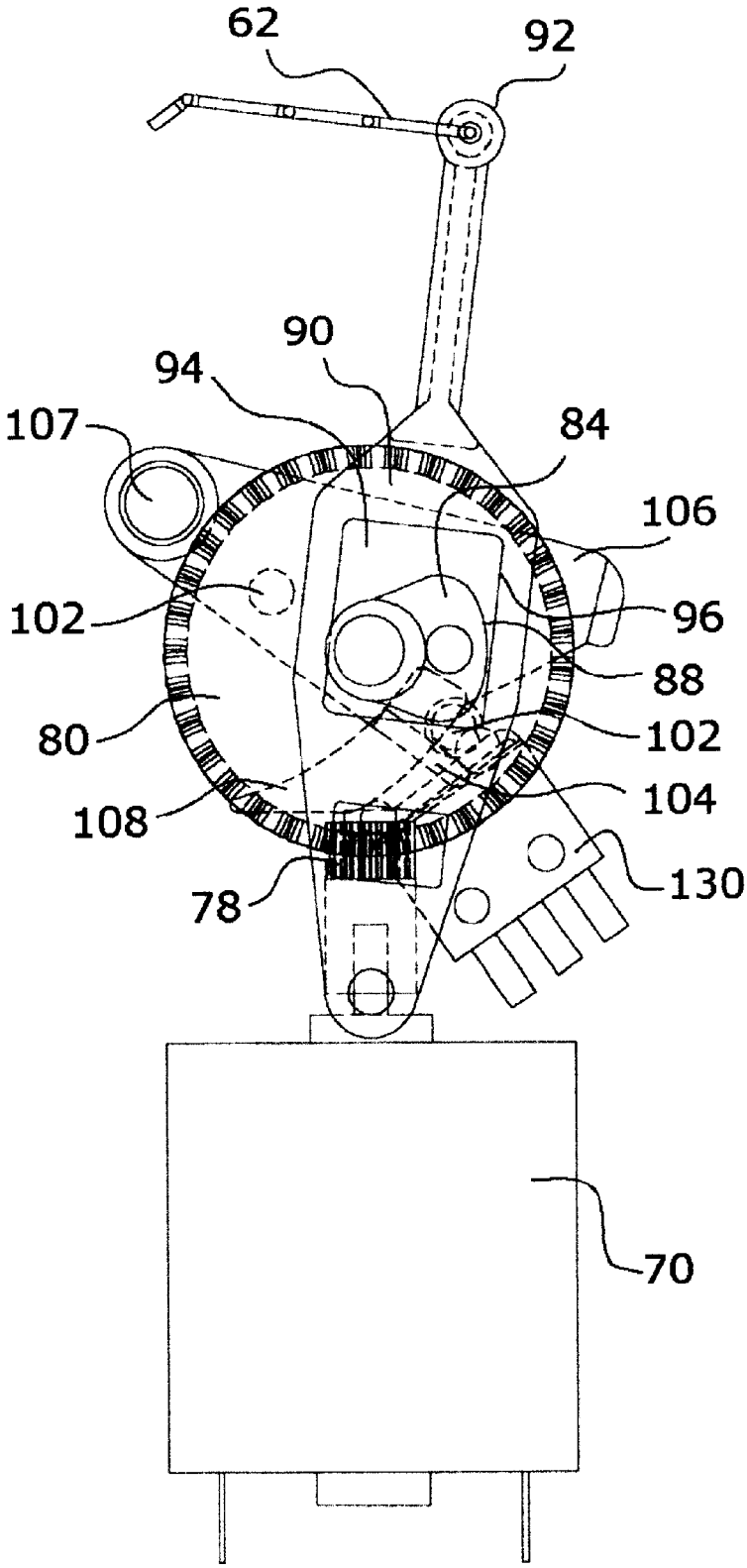
FIG. 7 shows the lever in a right terminal position.

In response to a drive current, the driveshaft 76 can rotate in a direction determined by the position of a cut-out switch 130 with two selectable positions. As the cam 84 causes the lever 90 to complete a transition from one terminal position to another, the cut-out switch 130 moves from one of its selectable positions to the other. The terminal positions of the lever are shown in FIG. 6 and 7. The actuation of the cut-out switch 130 is accomplished by two trip-posts 102 mounted on the crown gear 80. Depending on the current position of the cut-out switch 130, one or other of the trip-posts 102 drives against a tab 104 of a latch 106, shown in FIGS. 3 and 6, to actuate the cutout switch 130, thereby interrupting the drive current. When the trip-post 102 pushes against the tab 104, the latch 106 rotates about a pivot point 107 and a ramp 108 on the latch, shown in FIG. 3, causes the cut-out switch to change states thereby removing power to the motor 70.

Thus, in response to the movement of the cut-out switch 130, the rotation of the motor 70 ceases. It is emphasized that the trip-posts 102 are positioned so that they do not actuate the switch 130 until the transition of the lever 90 is effectively complete; otherwise the drive current would be prematurely interrupted. The electrical operation of the apparatus 20 will be described later in further detail.

Figure 3:
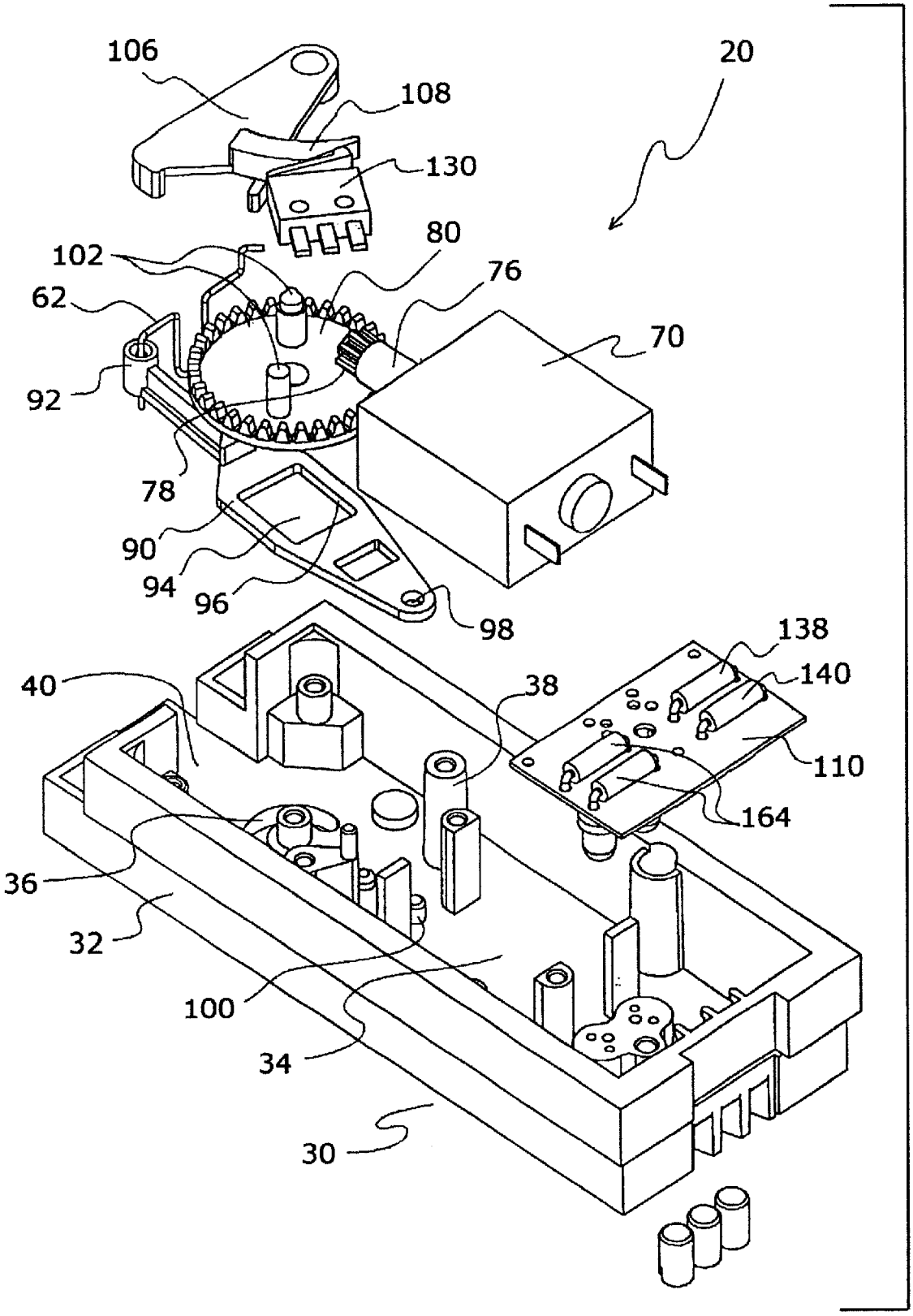
FIG. 3 shows an exploded view of the switch machine from below.

It is important to note that on the opposite side of the crown gear from the motor pinion contact point there is a support post 38 on the top portion 34, shown in FIG. 3, that assures intimate contact between the crown gear 80 and the pinion gear 78.

The structural parts of the apparatus 20 are typically made from plastic. In particular, the face gear 80, the cam 84, the cam-post 86 and the trip-posts 102 are typically molded together as an integral part.

The switching apparatus 20 includes a printed circuit board 110. An electronic circuit 112 for a first embodiment of the apparatus 20 is illustrated in FIG. 1, wherein are shown areas corresponding to the apparatus 20, a controller 120 and a source 122 of alternating current such as provided on most toy train transformers. A first side 72 of the motor 70 is connected the AC source 122, and a second side 74 is connected to the cut-out switch 130 at a common terminal 132. The switch is driven by the lever 90, which is best shown in FIG. 3. The cut-out switch 130 selectably closes against a left terminal 134 or a right terminal 136, which are respectively connected to a left diode 138 and a right diode 140. The diodes 138 and 140 connect respectively to a left input terminal 142 and a right input terminal 144, and is electrically oriented in opposite directions relative to the motor 70. Thus, current of opposite polarity is supplied to the motor 70 according to which of the diodes 138 or 140 are actuated.

The left input terminal 142 can be connected to ground by closing a control switch such as a left push button switch 150; if the cut-out switch 130 is closed against the left terminal 134, as shown in FIG. 1, this completes an electrical circuit which includes the motor 70 and the left diode 138; the drive current then flows in a selected direction through the motor 70, as determined by the left diode 138. Similarly, when the cut-out switch 130 is closed against the right terminal 136 and a right push button switch 152 is actuated, the drive current flows through the motor 70 in the opposite direction as determined by the right diode. The driveshaft 76 rotates accordingly and drives the face gear 80 and cam 84, the lever 90, the coupling 62 and the track switch 52 in the appropriate direction. It is evident from FIG. 1 that if the wrong push button switch is operated, e.g., the right push button switch 152 is actuated when the cut-out switch 130 is closed against the left terminal 134, no drive current can flow. The push button switches 150 and 152 are preferably constructed so that they remain closed just long enough to preclude the drive current from being interrupted prematurely.

As indicated earlier, the trip-posts 102 move the cut-out switch 130 to its alternate position when the lever 90 reaches its new terminal position, breaking electrical contact at one of the input terminals 142 or 144, then immediately creating contact at the opposite input terminal 144 or 142. This disconnects the drive current and stops the motor 70 without, however, establishing an opposite drive current until the next actuation of the appropriate push-button switch 150 or 152.

Being able to tell the position of the track switch 52 at a distance is important to alert the operator to possible problems if the track switch 52 is not thrown to the proper position. This is sometimes done with flags or colored lamps, but these are often not easily seen or are large and subject to burnout in the case of lamps. To solve these problems the switch apparatus 20 and remote controller 120 are equipped with light emitting diodes (LEDs).

Figure 2:
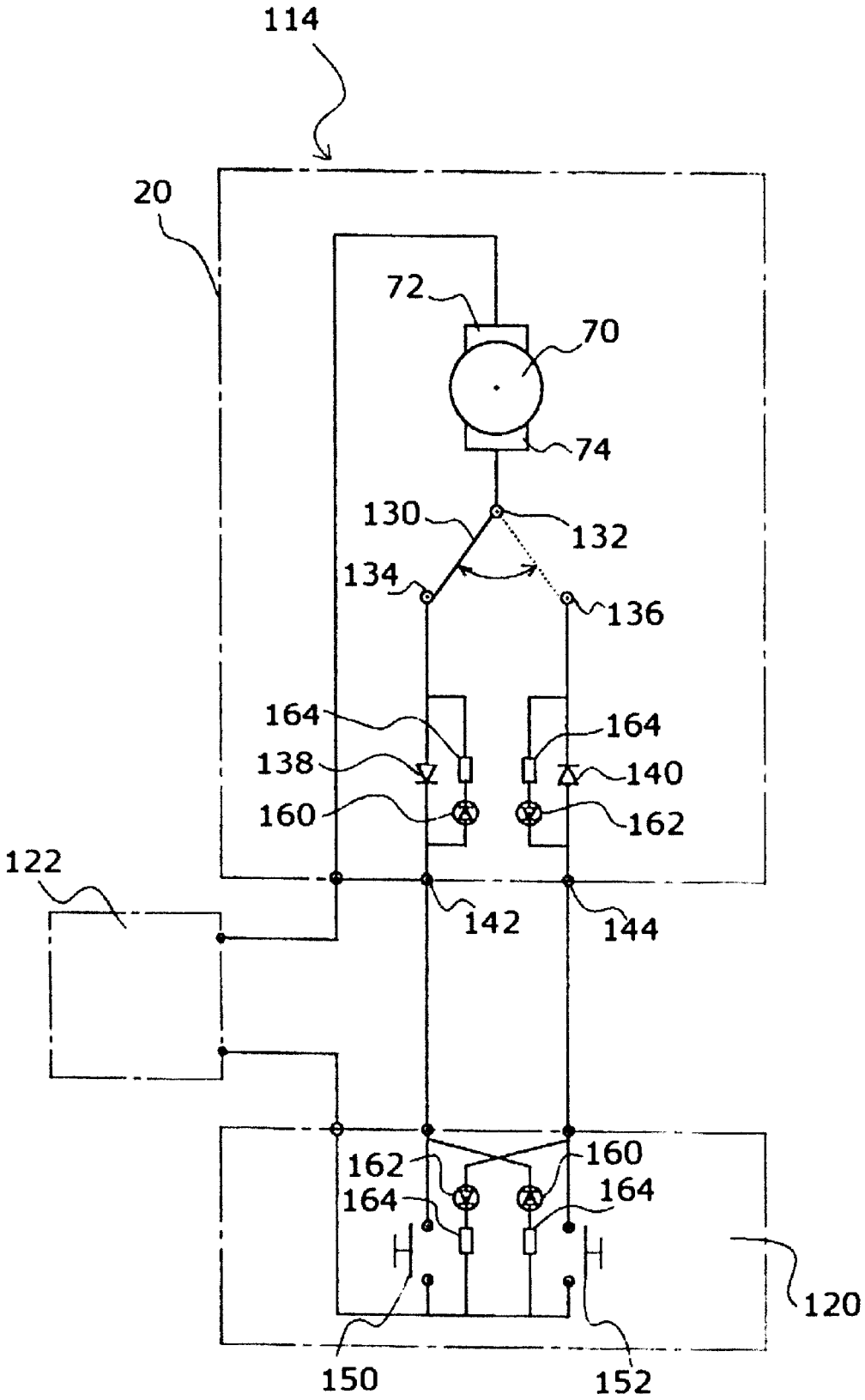
FIG. 2 shows an alternative electronic circuit for a switch machine and controller.

Referring again to FIG. 1, the first embodiment of the switching apparatus 20 has a green LED 160 and a red LED 162. It is not only desirable to show the state of the switch, but in particular to have an indication characteristic of whether the switch is thrown for straight through travel or for a turnout. Generally, if the green LED is illuminated, the switch is understood to be set for straight through or mainline travel. Conversely, if the red LED is illuminated the switch is in a turnout position. This can also be accomplished in a second embodiment of the invention, which has an alternative circuit 114 as shown in FIG. 2. With circuits 112 and 114 as configured in the states illustrated in FIGS. 1 and 2, the green LEDs 160 would be illuminated.

It should be noted that the LEDs 160 and 162, and current-limiting resistors 164 are aligned such that current powering the LEDs will flow through the motor 70. However, this residual current is not large enough to cause the motor 70 to operate. In the circuit 112 of FIG. 1, the residual current opposes the direction of flow of the most recent drive current, while in the alternative circuit 114 of FIG. 2, it can be seen that the residual and the most recent drive currents have the same polarity. If the residual current were large enough to be a concern, the alternative circuit 114 would be preferred, and can indeed be used to advantage. In a switching apparatus 20 for 00, H0, 0 or S gauge, the residual current could typically about 10 ma, or about an order of magnitude less than the typical motor drive current of the order of 100 ma. While insufficient to actually drive the motor 70, this residual current nevertheless provides a small holding force by trying to drive the motor 70 in the same direction as the most recent drive current. In other words, the residual current in the alternative circuit 114 tends to hold the track switch 52 closed in the intended position. The magnitude of the drive current would be in part determined by the choice of resistors 164.

If the switch machine were permanently coupled to the track switch 52 as is currently the case with some manufactured switches, the green led 160 and red led 162 would respectively be wired to correspond to straight through and turnout travel, as indicated earlier. Sometimes, however, the switch apparatus can optionally be mounted on either side of the track 50, and the problem is then assuring that the colors correctly indicate the track switch position. This switch apparatus provides sockets 166 on the PCB into which the LEDs are plugged, permitting the operator to easily unplug the LEDs after the switch apparatus is mounted and to plug them back into the printed circuit board to provide the correct color indication. This is made easier by providing a "D" shaped hole 42 in the cover that encourages a match to a flat on the LED, as shown in FIG. 4.

In summary, then, the invention has the following advantages. The apparatus 20 provides a compact, track-level electrical device for smoothly driving a model railroad track switch 52 so as to simulate the operation of a real track-switch; it further provides for intentional manual operation of the track switch 52; it can further provide a residual holding current which reinforces the track switch 52 in its intended position; and it precludes reverse operation of the apparatus 20 by the track switch 52. The apparatus 20 does not rise above the height of its associated track and can easily be accommodated within the minimum distance by which adjacent lines of track are spaced apart to maintain sufficient clearance between passing trains.

The apparatus 20 has been shown and described in connection with model railroad switches, but it will be understood that the invention is not limited to this application. It could be used in any application where a smooth transition is desired. Whereas preferred forms of the invention have been shown and described, it will realized that modifications may be made thereto without departing from the scope of the following claims.

What is claimed is:

1. A switching apparatus for a model railroad track having a track switch, comprising:

(a) a longitudinal housing with an opening;

(b) an electric motor mounted to the housing and having a longitudinal output shaft;

(c) a pinion attached to the output shaft;

(d) a face gear engaging the pinion and being rotatable about a generally vertical axis;

(e) a cam connected to the face gear;

(f) an elongate lever, one end of which protrudes outside the housing through the opening and is operably connected with the track switch, the lever having a cam-following surface engaging the cam in a relationship which permits the cam to drive the lever so that the track switch is moved laterally, but precludes the cam moving in response to a force on the lever; and (g) a cut-out switch which is actuated when the apparatus, in response to a current driving the motor, reaches one of the selected positions, causing the drive current to be interrupted.

2. The apparatus of claim 1, wherein the cam has a functional surface, which is generally concentric with the face gear.

3. The apparatus of claim 1, wherein the cut-out switch is actuated by a latch, which is tripped by a post, mounted on the face gear.

4. The apparatus of claim 1, wherein a residual current can pass through the motor to maintain the apparatus in the selected position.

5. The apparatus of claim 1, wherein the cam has a manual actuator permitting rotation of the face gear for manually moving the track switch.

6. The apparatus of claim 1, wherein the motor is a DC motor and the drive current is rectified current from an AC power source.

7. The apparatus of claim 6, wherein the AC is rectified by a diode.

8. The apparatus of claim 7, wherein the cut-out switch can be selectably configured to direct the rectified current in either direction through the motor.

9. The apparatus of claim 7, wherein a visual indicator is actuated in response to the configuration of the cut-out switch.

10. The apparatus of claim 9, wherein the indicator is an LED.

11. The apparatus of claim 10, wherein the LED is powered by the residual current.

12. The apparatus of claim 10, wherein the LED is green.

13. The apparatus of claim 10, wherein the LED is red.

14. The apparatus of claim 11, wherein the drive current is of the order of 100 ma and the residual current is of the order of 10 ma.

15. A switching apparatus capable of translation between selected positions and including an electric motor operably connected to a cam which is constructed to drive a lever between selected positions, the lever being precluded from driving the cam; a coupling through which the lever is operably connected to the switching apparatus; and an electronic circuit which can provide a drive current to the motor, the circuit comprising:

(a) a cut-out switch which is operably connected to the lever and has a common terminal connected to one end of the motor, and also has positions wherein it is closed against either a first or a second terminal;

(b) a first diode connected to the first terminal and a second diode connected to the second terminal, the first and second diodes being connected in opposed directions relative to the motor; and (c) a first input terminal connected to the first diode, and a second input terminal connected to the second diode, the input terminals being correspondingly connected to a first and second control switch;

so that when the cut-out switch is closed against the first terminal and the first control switch is actuated, an alternating current is rectified by the first diode and drives the motor so that it moves the lever from one terminal position to the other terminal position, whereat the cam actuates the cut-out switch causing it close against the second terminal, the drive current then being interrupted until the second control switch is actuated, whereupon the alternating current is rectified by the second diode and drives the motor so that it moves the lever in the reverse direction.

16. The apparatus of claim 15, wherein the electronic circuit includes an LED and is configured so that a residual current can pass through both the LED and the motor while the drive current is interrupted.

17. The apparatus of claim 16, wherein the electronic circuit is configured so that the residual current has the same polarity at the motor as the most recent drive current.

18. A switching apparatus for a model railroad track switch, the apparatus comprising:

(a) an electric motor having an output shaft;

(b) a cam operably connected to the output shaft;

(c) a lever having a cam-following surface engaging the cam in a relationship which permits the cam to drive the lever between selected positions, but precludes movement of the cam in response to a force on the lever; and (d) a cut-out switch actuated when the lever reaches one of the selected positions.

19. The switching apparatus of claim 18, wherein the cam-following surface and the cam are selected so that a force on the lever exerts a resultant force on the cam having insufficient moment about an axis of rotation of the cam to cause rotation of the cam.

20. The switching apparatus of claim 18, further comprising gearing operably connected to the output shaft to transmit rotation of the shaft to the cam.

21. An electronic circuit for reversibly providing a drive current to a DC motor in a switching apparatus which is capable of translation between selected positions, the motor being operably connected to the switching apparatus through a cam and a lever, the circuit comprising:

(a) a cut-out switch which is operably connected to the lever, has a common terminal connected to the motor, and further has positions wherein it is closed against either a first or a second terminal;

(b) a first diode connected to the first terminal and a second diode connected to the second terminal, the first and second diodes being connected in opposed directions relative to the motor; and (c) a first and a second control switch connected respectively to the first and the second diode;

so that when the cut-out switch is closed against the first terminal and the first control switch is actuated, an alternating current is rectified by the first diode and drives the motor so that it moves the lever from a first selected position to a second selected position, the cam cut-out switch then being actuated causing the cut-out switch to close against the second terminal, thus interrupting the drive current until the second control switch is actuated, whereupon the alternating current is rectified by the second diode and drives the motor so that it moves the lever from the second selected position to the first selected position.

22. The circuit of claim 21, further configured to illuminate an LED according to the position of the lever, the circuit further being configured so that a residual current powering the LED also passes through the motor while the drive current is interrupted.

23. The circuit of claim 22, further being configured so that the residual current passes through the motor in the same direction as the most recent drive current.

24. An electronic circuit for providing a reversible drive current through a DC motor which drives a switching apparatus, the circuit comprising:

(a) a cut-out switch operably connected to the switching apparatus, the cut-out switch having a common terminal connected to the motor, and further being movable between positions wherein it is closed against either a first or a second terminal;

(b) a first diode connected to the first terminal and a second diode connected to the second terminal, the first and second diodes being connected in opposed directions relative to the motor; and (c) a first and a second control switch connected respectively to the first and the second diode;

so that when the cut-out switch is closed against the first terminal and the first control switch is actuated, an alternating current is rectified by the first diode and actuates the motor so that it drives the apparatus from a first selected position to a second selected position, the cut-out switch then being actuated causing the cut-out switch to close against the second terminal, thus interrupting the drive current until the second control switch is actuated, whereupon the alternating current is rectified by the second diode and actuates the motor so that it drives the apparatus from the second to the first selected position.

25. The circuit of claim 24, further configured to illuminate an LED according to the position of the apparatus, the circuit further being configured so that a residual current powering the LED also passes through the motor while the drive current is interrupted.

26. The circuit of claim 25, further being configured so that the residual current passes through the motor in the same direction as the most recent drive current.

* * * * *